US008887986B2

(12) United States Patent
Berendes

(10) Patent No.: US 8,887,986 B2
(45) Date of Patent: Nov. 18, 2014

(54) CONTAINER FOR RECEIVING VOUCHERS AND METHOD FOR CLOSING CONTAINER HAVING A HOUSING PART AND A COVER FOR RECEIVING VOUCHERS

(75) Inventor: Elmar Berendes, Warburg Noerde (DE)

(73) Assignee: Wincor Nixdorf International GmbH (DE)

( * ) Notice: Subject to any disclaimer, the term of this patent is extended or adjusted under 35 U.S.C. 154(b) by 186 days.

(21) Appl. No.: 13/390,060

(22) PCT Filed: Aug. 12, 2010

(86) PCT No.: PCT/EP2010/061761

§ 371 (c)(1),
(2), (4) Date: Apr. 20, 2012

(87) PCT Pub. No.: WO2011/018499

PCT Pub. Date: Feb. 17, 2011

(65) Prior Publication Data

US 2012/0199507 A1 Aug. 9, 2012

(30) Foreign Application Priority Data

Aug. 13, 2009 (DE) ..... 10 2009 037 459

(51) Int. Cl.
*G07B 15/00* (2011.01)
*G07D 11/00* (2006.01)

(52) U.S. Cl.
CPC ..... *G07D 11/0009* (2013.01); *Y10S 902/13* (2013.01)
USPC ..... 232/15; 232/16; 109/45; 109/64; 902/13

(58) Field of Classification Search
USPC ..... 232/1 D, 15, 16, 43.3, 43.1; 235/379; 902/13, 9; 109/45, 47, 52, 64, 66, 67; 194/351; 221/154, 197; 292/130, 230; 70/63, 84, 162
See application file for complete search history.

(56) References Cited

U.S. PATENT DOCUMENTS 4,275,667 A 6/1981 Hilton
4,529,119 A * 7/1985 Granzow et al. ..... 232/43.3

(Continued)

FOREIGN PATENT DOCUMENTS

DE 10311928 A1 9/2004
DE 102008044838 A1 3/2010
FR 2607295 A1 5/1988

OTHER PUBLICATIONS

International Search Report (in English) and Written Opinion of the International Searching Authority (in Germany) for PCT/EP2010/061761, mailed Dec. 10, 2010; ISA/EP.

(Continued)

*Primary Examiner* — William Miller
(74) *Attorney, Agent, or Firm* — Harness, Dickey & Pierce, P.L.C.

(57) ABSTRACT

The invention relates to a container (10) for holding notes of value, which comprises a housing part (12) and a cover (14) for closing an opening of the housing part (12). The cover (14) has a closing element (34) which is movable in at least one unlocking direction (P1) and which in a locked state is engaged with an engagement area (48) of the housing part (12) that is complementary to the closing element (34). The closing element (34) is movable in unlocking direction (P1) into an unlocked state for unlocking. Further, the container (10) comprises a rotatably mounted retaining element (58) which, in a first position of the container (10), is arranged such that the closing element (34) is movable in unlocking direction (P1) from the locked state into the unlocked state for unlocking. In a second position of the container (10) that is inclined by at least a minimum angle of inclination with respect to the first position, the retaining element (58) is rotated due to its gravity relative to the housing part (12) such that a retaining area (64) of the retaining element (58) prevents a movement of the closing element (34) from the locked state into the unlocked state.

20 Claims, 9 Drawing Sheets

(56) References Cited

U.S. PATENT DOCUMENTS

| | | | | |
|---|---|---|---|---|
| 4,655,368 | A | 4/1987 | Bateman et al. | |
| 4,659,008 | A * | 4/1987 | Howett et al. | 232/43.3 |
| 4,798,316 | A * | 1/1989 | Martin et al. | 232/43.1 |
| 4,890,766 | A * | 1/1990 | Martin et al. | 221/198 |
| 5,012,075 | A * | 4/1991 | Hutchison et al. | 235/379 |
| 6,802,550 | B1 | 10/2004 | Griggs, Jr. et al. | |
| 8,500,000 | B2 * | 8/2013 | Berendes | 232/15 |
| 8,540,143 | B2 * | 9/2013 | Cha et al. | 235/379 |
| 2004/0201238 | A1 | 10/2004 | Griggs et al. | |
| 2006/0236612 | A1 | 10/2006 | Sheng et al. | |
| 2011/0155736 | A1 | 6/2011 | Berendes | |

OTHER PUBLICATIONS

International Preliminary Report on Patentability (Chapter I of the Patent Cooperation Treaty) in English for PCT/EP2010/061761, issued Feb. 14, 2012; ISA/EP.

* cited by examiner

CONTAINER FOR RECEIVING VOUCHERS AND METHOD FOR CLOSING CONTAINER HAVING A HOUSING PART AND A COVER FOR RECEIVING VOUCHERS

CROSS-REFERENCE TO RELATED APPLICATIONS

This application is a National Stage of International Application No. PCT/EP2010/061761, filed Aug. 12, 2010. This application claims the benefit and priority of German application 10 2009 037 459.0, filed Aug. 13, 2009. The entire disclosures of the above applications are incorporated herein by reference.

BACKGROUND

This section provides background information related to the present disclosure which is not necessarily prior art.

TECHNICAL FIELD

The invention relates to a container for holding notes of value, which comprises a housing part having at least one opening and in which the notes of values can be held and a cover for closing this opening. The cover comprises a closing element movable in at least one unlocking direction, the closing element being engaged in a locked state with an engagement area of the housing part that is complementary to the closing element so that the cover is firmly connected to the housing part. For unlocking, the closing element is movable in unlocking direction into an unlocked state so that the cover can be opened. Further, the invention relates to a method for closing a container for holding notes of value that comprises a housing part and a cover.

Discussion

The container is in particular a cash cassette which is used in automated teller machines, automatic cash systems and/or automatic cash safes. Such cash cassettes serve to hold banknotes and to transport the banknotes between the automated teller machines, the automatic cash systems, the automatic cash safes and/or so-called cash centers in valuable transport companies or central banks. Known cash cassettes comprise a cover that can be removed from the cash cassette or can be hinged open so that employees of the cash center can easily remove the banknotes contained in the cash cassette and/or can easily fill the cash cassette with banknotes. The cover is connected to the cash cassette via a closing mechanism, the closing mechanism comprising at least one closing element which is held in a locked position by means of a tension spring. For unlocking, the closing element is moved against the force of the tension spring by the manual actuation of a key by an operator so that the closing element is no longer engaged with a housing part of the cash cassette and the cover can be removed or, respectively, hinged open. Here, tension springs are used, the spring rates of which have a relatively small value so that the cassette can be comfortably opened by the operator. Here, it is disadvantageous that the cassette cover can spring open unintentionally when a force is exerted on the cassette, for example when the cassette is dropped by mistake, because the closing element, due to its inertia and its impulse upon impact, is moved from the locked state into the unlocked state against the small force of the tension spring resulting from the low spring rate.

One possibility of preventing such unintentional springing open of the cover when dropping the cash cassette is to use a tension spring having a high spring rate. Here it is disadvantageous that for opening the closing mechanism a high force has to be applied by the operator, as a result whereof the handling of the cash cassette is made more difficult.

From German Patent Application DE 10 2008 044 838, a device for locking and unlocking a shutter of a container which can be moved into and out of a rack is known. The shutter is pulled open by a stationary pin engaging therewith upon insertion of the container and is pulled closed by the same engagement of the pin when the container is pulled out of the rack.

SUMMARY OF THE INVENTION

It is an object of the invention to specify a container for holding notes of value and a method for closing a container for holding notes of value that comprises a housing part and a cover, in which a housing part and a cover can easily be locked with each other such that the container remains closed even under shock load.

By providing a retaining element which is rotatably mounted about an axis of rotation and which, in a first position of the container, is arranged such that the closing element can be moved in unlocking direction into the unlocked state for unlocking and which, in a second position of the container, is —due to its gravity—rotated relative to the housing part with respect to the first position of the container such that a retaining area of the retaining element prevents movement of the closing element from the locked state into the unlocked state, it is achieved that the closing element, when the container experiences a shock load, in particular when the container is dropped, is not moved in unlocking direction into the unlocked state due to its impulse and its inertia. Thus, it is prevented that the closing element, as a result of the shock load, is unintentionally released from the locked state and the cover of the container is opened. In this way, it is in turn achieved that the notes of value contained in the container do not fall out of the container when the container is dropped so that no notes of value will get lost either.

In the second position, the container is inclined with respect to the first position by at least a minimum angle of inclination. The first position is in particular the position in which the notes of value are supplied to the container. When the container drops down, the container is inclined with respect to this first position in particular by an angle of about 90°. In the second position, the container is in particular inclined such that the front end of the container, as viewed in unlocking direction, is directed downward toward the floor.

When the container is arranged in the second position, the housing part and the retaining element are in particular arranged relative to each other such that the retaining area of the retaining element is arranged upstream of the closing element in its locked state, as viewed in unlocking direction. By means of the retaining area, a displacement of the closing element into the unlocked state is mechanically prevented. Here, the retaining element is preferably arranged such that the closing element can indeed be moved a little in unlocking direction but not so far that the closing element can be moved from the locked state into the unlocked state. Alternatively, the retaining area of the retaining element can be arranged in an aligned manner in front of the closing element when the container is arranged in the second position so that the closing element cannot be moved in unlocking direction.

The retaining element is in particular mounted to the housing part rotatably about the axis of rotation. When the container and thus also the housing part are rotated about an axis running parallel to the axis of rotation of the retaining element, then the retaining element maintains its absolute orientation due to the rotatable mounting and its gravity so that the orientation of the housing part and of the retaining element relative to each other changes. In this way, it is achieved that the retaining element and the housing part, given an inclination of the container at least by the minimum angle of inclination, are automatically arranged to each other such that the retaining element prevents movement of the closing element from the locked state into the unlocked state. A movement of the retaining element by means of an actuator and/or a manual movement of the retaining element are not necessary.

The container is preferably a cash cassette in which in particular banknotes can be held as notes of value. The first position is preferably the position of the cash cassette which the cash cassette has when it is inserted into an automated teller machine, in an automatic cash system or in an automatic cash safe. The cash cassette has a handle for carrying the cash cassette, wherein the cash cassette, when carried on the handle, is inclined by at least the minimum angle of inclination. As the cash cassette, when carried, is inclined by at least the minimum angle of inclination it is ensured that, during carrying, the retaining element is arranged such that it prevents a movement of the closing element from the locked state into the unlocked state. Thus, an unintentional opening of the cash cassette, in particular when it is dropped during transport, is prevented. The container, when inclined by the minimum angle of inclination, is preferably inclined such that the end of the container lying in unlocking direction is inclined downward. When such a container inclined by at least the minimum angle of inclination experiences a shock load, then the closing element is maintained in the locked state due to the retaining element that is swiveled in front of the closing element as viewed in unlocking direction.

It is advantageous when a housing bottom formed by an area of the housing part of the container is arranged horizontally in the first position and when the retaining element prevents a movement of the closing element from the locked state into the unlocked state as soon as the container is inclined by at least 15° with respect to the first position. In this way, it is achieved that, already when the container is only slightly inclined, the retaining element is arranged such that the closing element cannot be moved from the locked state into the unlocked state so that, even when the container is only slightly inclined, the closing element will not be disengaged from the engagement area of the housing part when subjected to a shock load.

Further, it is advantageous when the retaining element, due to its gravity and the rotatable mounting, automatically rotates relative to the housing part from a position in which it prevents a movement of the closing element from the locked state into the unlocked state again in a position in which the closing element can be moved from the locked state into the unlocked state when the container, after it had been inclined by at least the minimum angle of inclination, is again brought into a position in which it is not inclined or inclined by an angle smaller than the minimum angle of inclination. In this way, it is achieved that the container, after it had again been brought into a position with an inclination having an angle smaller than the minimum angle of inclination, in particular again into the first position, can be opened by moving the closing element in unlocking direction from the locked state into the unlocked state.

The retaining element has in particular the form of a hook having two legs. A first end region of the first leg is connected to a first end region of the second leg. The axis of rotation extends through a second end region of the first leg opposite to the first end region. The retaining element is in particular formed such that the center of gravity of the retaining element is located within the first leg and is arranged as close as possible to the surface of the first leg facing the second leg. The distance from the center of gravity of the retaining element to the surface of the first leg facing the second leg is preferably smaller than the distance between the center of gravity and the surface of the first leg facing away from the second leg. A respective position of the center of gravity is in particular achieved in that the second leg has a recess for weight saving. The retaining area is in particular formed by a second end region of the second leg opposite to the first end region of the second leg. By way of the afore-described position of the center of gravity, it is achieved that already in the case of a small minimum angle of inclination the retaining element is pivoted relative to the housing part such that the retaining element prevents a movement of the closing element from the locked state into the unlocked state. Thus, the retaining element does not have to be brought into the position in which the retaining element prevents a movement of the closing element from the locked state into the unlocked state by way of an actuator and/or a manual intervention as this takes place automatically as a result of the gravity of the retaining element. Thus, in contrast to a manual movement of a retaining element, the movement of the retaining element into the position preventing a movement of the closing element from the locked state into the unlocked state cannot be forgotten.

In a preferred embodiment of the invention the retaining area of the retaining element has a projection, preferably a nose. The closing element has a recess that is complementary to this projection, wherein the recess and the projection are arranged such that they are engaged with each other at least when the container is inclined by at least the minimum angle of inclination so that the retaining element is rotated such that is prevents a movement of the closing element from the locked state into the unlocked state, and when a shock directed opposite to the unlocking direction acts on the container. This shock causes that the closing element is moved in unlocking direction due to its impulse and its inertia. Before the shock acts on the container, the retaining element is indeed arranged such that the closing element cannot be brought into the unlocked state but the projection and the recess are not yet engaged with each other. Only as a result of the shock, the closing element is moved so far in unlocking direction that the projection and the recess are engaged with each other. In this way, it is achieved that the retaining element is not again rotated relative to the housing part due to the shock such that the closing element can be moved into the unlocked state. After the shock, the closing element is again moved opposite to the unlocking direction, for example by a tension spring, such that the projection and the recess are no longer engaged. Thus, the retaining element is again movable relative to the closing element so that also the closing element can be moved from the locked state into the unlocked state when the container is inclined by an angle smaller than the minimum angle of inclination.

Further, it is advantageous when the closing element can be maintained in the locked state by means of an elastic element, preferably a tension spring. In this way, it is achieved that the closing element can be moved from the locked state into the unlocked state in an easy manner, in particular by the manual actuation of a key.

In a preferred embodiment of the invention the closing element is a first closing element. In this embodiment, the cover comprises a bolting slide having the first closing element, a second, a third and a fourth closing element. Each of the closing elements preferably has an L-shape. In the locked state, each of the closing elements is engaged with an engagement area of the housing. By providing several closing elements, the cover is mounted more safely to the housing part than when using only one closing element. By providing all closing elements on only one common bolting slide, it is achieved that only this bolting slide has to be displaced in unlocking direction for opening the cover so that an easy handling of the container is achieved. For this, the bolting slide in particular has an actuating element, by the manual actuation of which the bolting slide is movable in unlocking direction such that the closing elements are no longer engaged with the housing part.

Further, the container can comprise a further retaining element which prevents movement of the second closing element from the locked state into the unlocked state when the container is arranged in the second position. Likewise, the container can comprise several further retaining elements, each retaining element preventing the movement of a closing element from the locked state into the unlocked state when the container is arranged in the second position. By using several retaining elements, protection against an unintentional opening of the cover is increased when the container experiences a shock load.

A further aspect of the invention relates to a method for closing a container for holding notes of value that comprises a housing part and a cover. In the method, a closing element of the cover for locking the container is brought into engagement with an engagement area of the housing that is complementary to the closing element so that the cover is firmly connected to the housing part in this locked state. For unlocking, the closing element is moved in unlocking direction into an unlocked state so that the cover can be opened. A retaining element which is rotatably mounted about an axis of rotation and which, in a first position of the container, is arranged such that the closing element is movable from the locked state into the unlocked state is rotated by its gravity relative to the housing part so that by means of a retaining area of the retaining element a movement of the closing element from the locked state into the unlocked state is prevented when the container is inclined at least by a minimum angle of inclination with respect to the first position.

BRIEF DESCRIPTION OF THE DRAWINGS

The drawings described herein are for illustrative purposes only of selected embodiments and not all possible implementations, and are not intended to limit the scope of the present disclosure.

Further features and advantages of the invention result from the following description which in connection with the enclosed Figures explains the invention in more detail with reference to embodiments.

Corresponding reference numerals indicate corresponding parts throughout the several views of the drawings.

DETAILED DESCRIPTION OF THE PREFERRED EMBODIMENTS

Example embodiments will now be described more fully with reference to the accompanying drawings.

Figure 1:
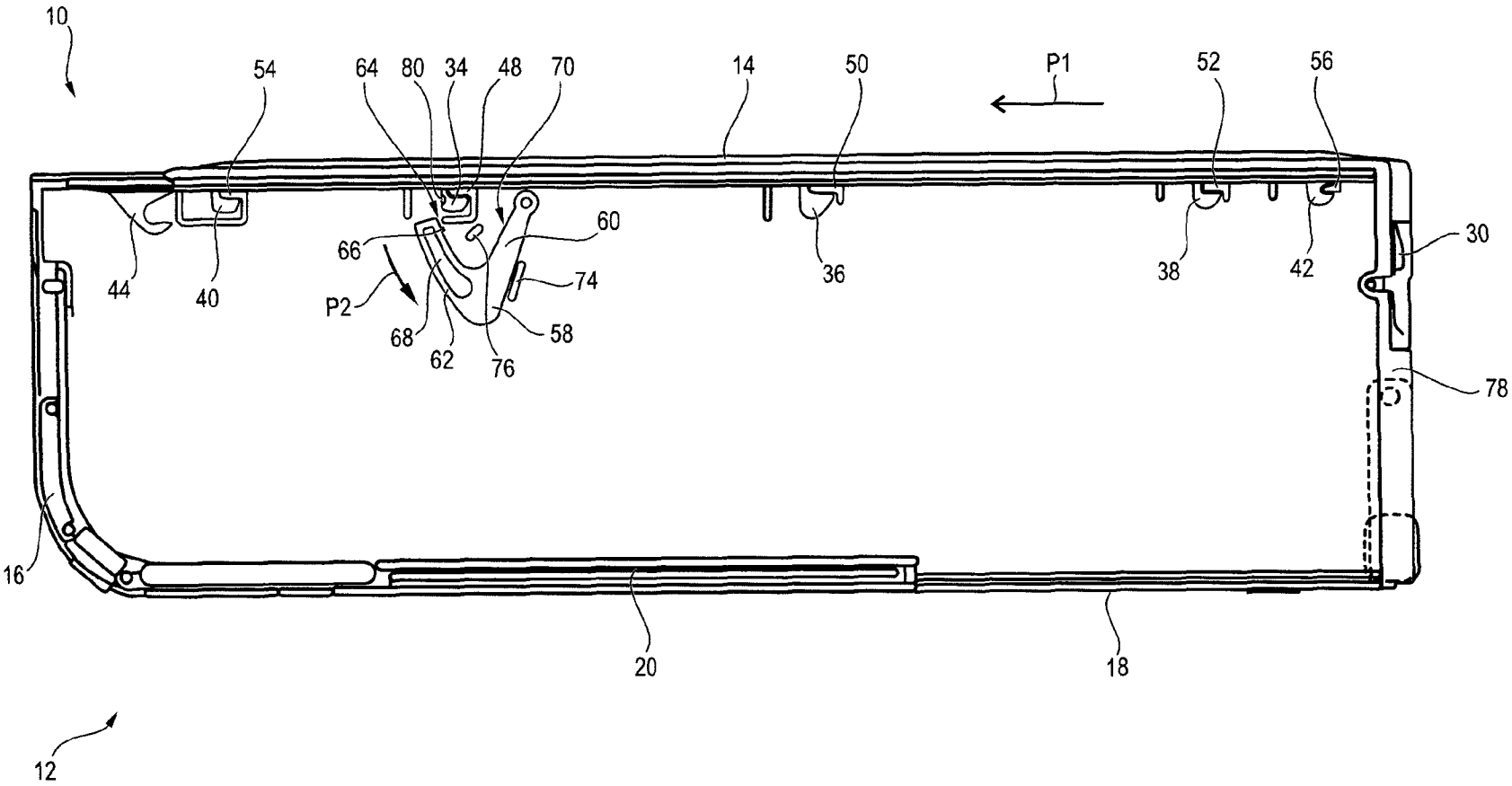
FIG. 1 shows a schematic illustration of a cash cassette arranged in a first position in a locked state.

In FIG. 1, a schematic illustration of a cash cassette 10 in a first position is illustrated. The cash cassette 10 serves to hold banknotes in particular in automated teller machines, automatic cash systems and/or automatic cash safes, and to transport banknotes between the automated teller machines, automatic cash systems, automatic cash safes and/or cash centers. The cash cassette 10 is arranged horizontally in the first position. The first position thus corresponds to the position in which the cash cassette 10 is arranged when it is inserted in an automated teller machine, an automatic cash system or an automatic cash safe or when it is filled and/or emptied by an employee of the cash center.

The cash cassette 10 comprises a housing part 12 having a first opening and a second opening. The banknotes are held within this housing part 12. In the first position of the cash cassette illustrated in FIG. 1, the first opening is arranged at the upper side of the housing part 12 and serves to fill the cash cassette 10 with banknotes in a cash center or, respectively, to empty the cash cassette 10 in a cash center. The first opening can be closed by means of a cover 14 so that the banknotes cannot fall out of the cash cassette 10 during transport of the cash cassette 10.

The second opening of the housing part 12 is closed by a shutter 16 in FIG. 1. The second opening serves to remove and/or supply banknotes when the cash cassette 10 is arranged in an automated teller machine, an automatic cash system or an automatic cash safe. When the cash cassette 10 is inserted into the automated teller machine, the automatic cash system or, respectively, the automatic cash safe, the shutter 16 is automatically moved into a receiving area 20 arranged at the housing bottom 18 so that the second opening is open and banknotes can be transported through the second opening. When the cash cassette 10 is removed from the automated teller machine, the automatic cash system or, respectively, the automatic cash safe, the shutter 16 is automatically closed again. The locking and unlocking of such a shutter 16 is described in U.S. Patent Publication 2011/0155736, the content of which is herewith incorporated into the present specification by reference.

Figure 2:
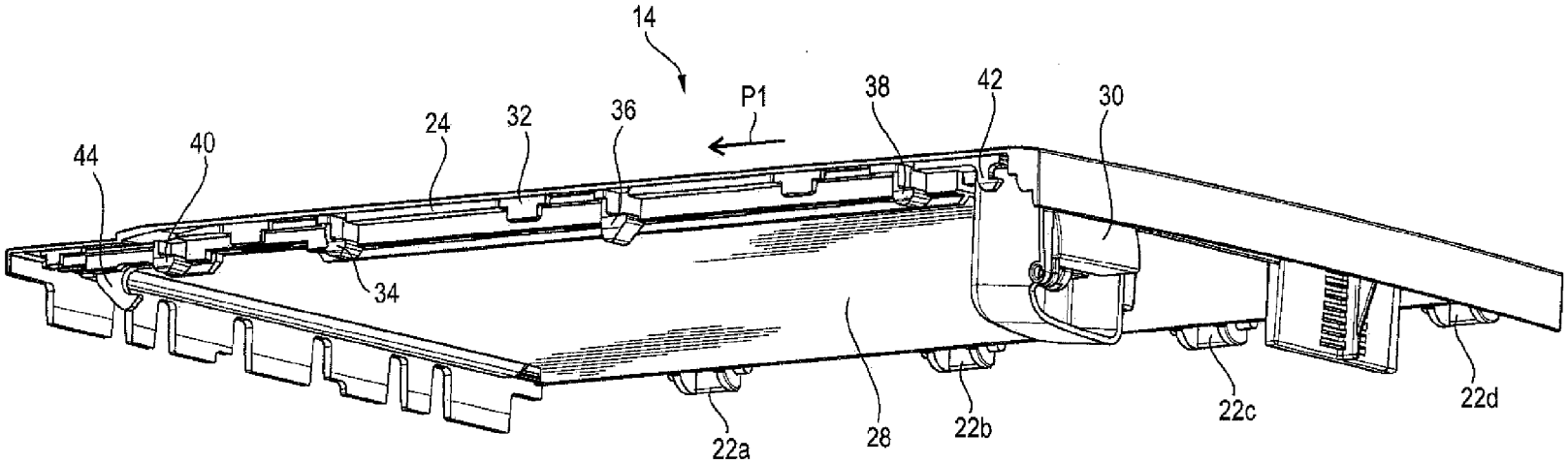
FIG. 2 shows a schematic perspective illustration of a cover of the cash cassette according to FIG. 1.

In FIG. 2, a schematic perspective illustration of the cover 14 is shown. Elements having the same structure and the same function are identified by the same reference signs. On a first side, the cover 14 has four mounting elements 22*a* to 22*d*, via which the cover 14 is connected to the housing part 12 such that the cover 14 is rotatable about an axis of rotation running through the mounting elements 22*a* to 22*d* so that the cover 14 can be hinged open relative to the housing part 12. In this way, it is achieved that the cover 14 always remains connected to the housing part 12 so that the cover 14 cannot get lost. In an alternative embodiment of the invention, the cover 14 can also be designed such that it can be removed from the housing part 12.

Figure 3:
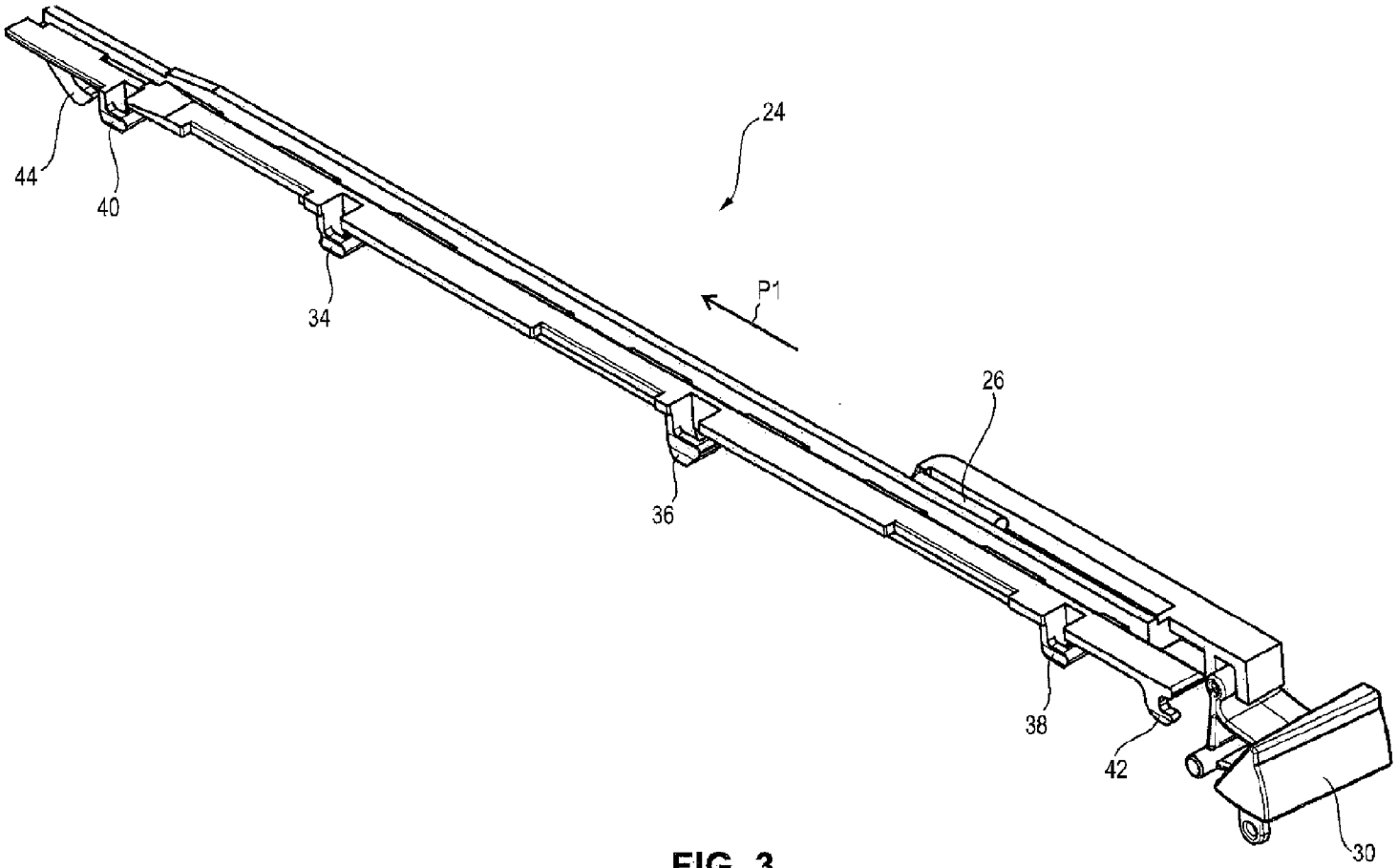
FIG. 3 shows a schematic perspective illustration of a bolting slide.

On a second side opposite to the first side, the cover 14 comprises a bolting slide 24 which is illustrated in detail in FIG. 3. The bolting slide 24 is connected via a tension spring 26 with a cover element 28 of the cover 14 closing the first opening of the housing part 12. By a manual actuation of an actuating key 30 of the bolting slide 24, the bolting slide 24 is movable against the spring force of the tension spring 26 in the direction of the arrow P1 in unlocking direction relative to the cover element 28 of the cover 14. After actuation of the actuating key 30, the bolting slide 24 is again moved back opposite to the unlocking direction P1 due to the spring force of the tension spring 26.

Further, the cover 14 comprises several guiding elements, one of which is exemplarily identified with the reference sign 32. The guiding elements 32 serve to laterally guide the bolting slide 24.

The bolting slide 24 comprises a first closing element 34, a second closing element 36, a third closing element 38, a fourth closing element 40, a fifth closing element 42 and a sixth closing element 44. The closing elements 34 to 44 are arranged at the side of the bolting slide 24 facing the housing part 12 when the cover is closed. The closing elements 34 to 42 are approximately L-shaped and, in the locked state shown in FIG. 1, they are engaged with engagement areas 48 to 56 that are complementary thereto so that the cover 14 cannot be opened in the locked state. The sixth closing element 44 is approximately shaped like a hook and, in the locked state shown in FIG. 1, is engaged with a non-illustrated bolt.

The bolting slide 24 is held in the locked state by the tension spring 26 so that the closing elements 34 to 44 are engaged with the engagement areas 48 to 56 and the housing part 12 and the cover 14 are locked with each other. As the bolting slide 24 is automatically moved into the locked state by the tension spring 26, the locking cannot be forgotten when closing the cover 14.

By actuating the actuating key 30, the bolting slide 24 and thus also the closing elements 34 to 44 are moved in unlocking direction P1 from the locked state into the unlocked state. To not unnecessarily complicate the displacement of the bolting slide 24 from the locked state into the unlocked state in unlocking direction P1, the tension spring 26 has a low spring rate.

Figure 4:
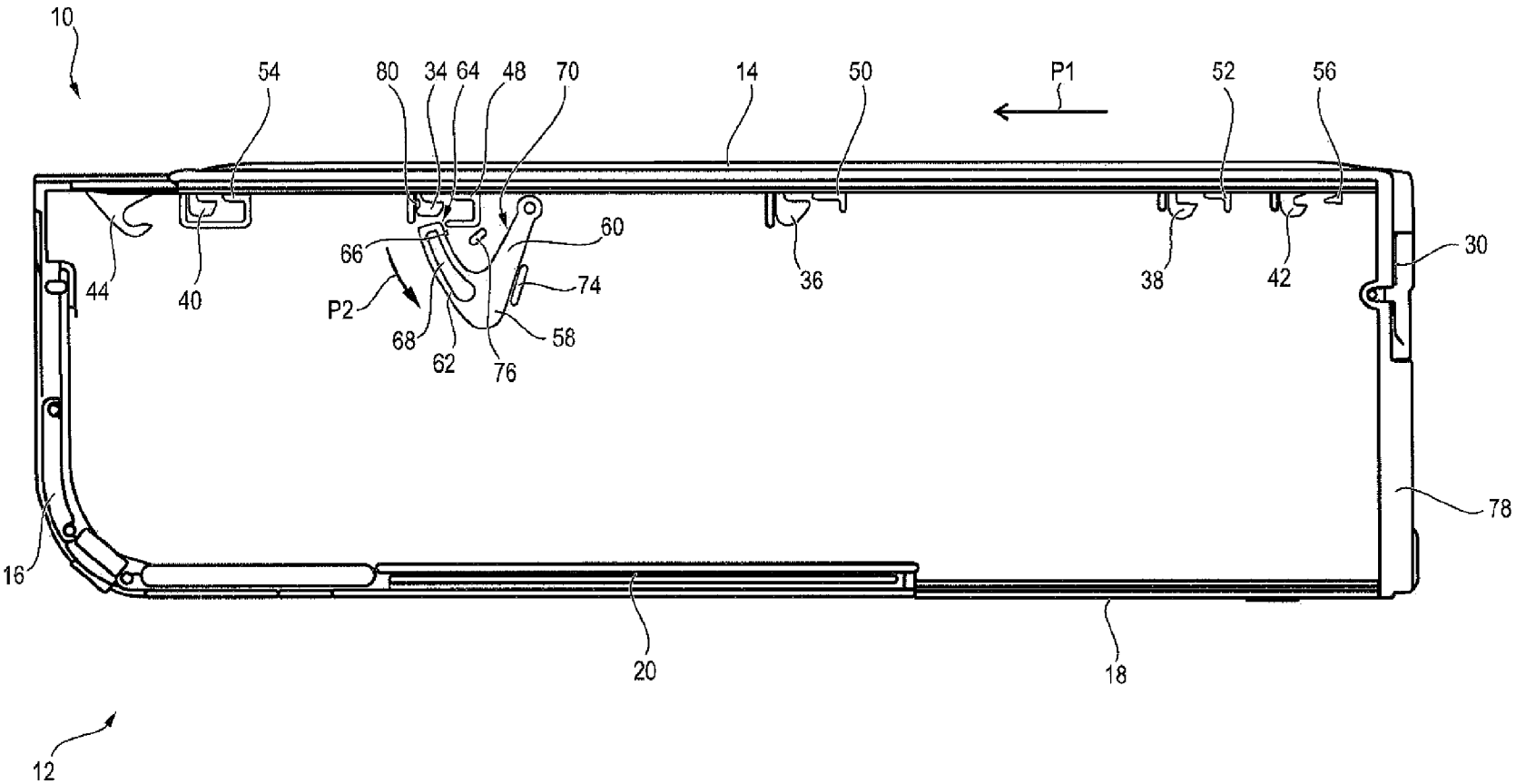
FIG. 4 shows a schematic illustration of the cash cassette according to FIG. 1 in the first position in an unlocked state.

In FIG. 4, a schematic illustration of the cash cassette 10 according to FIG. 1 is shown in the first position in the unlocked state. The bolting slide 24 is displaced in unlocking direction P1 so far that the closing elements 34 to 44 are no longer engaged with the engagement areas 48 to 56 of the housing part 12 so that the cover 14 can be hinged open.

Figure 5:
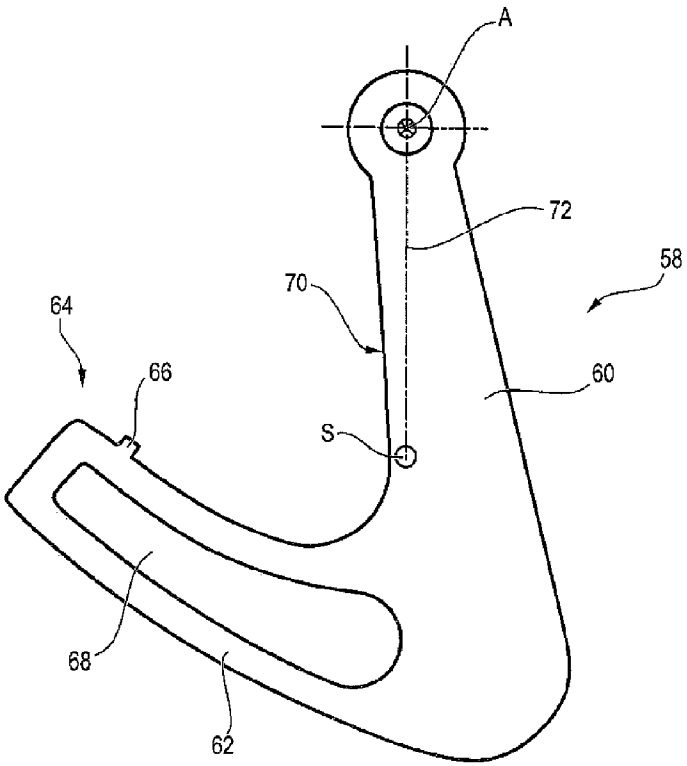
FIG. 5 shows a schematic illustration of a retaining element of the cash cassette according to FIGS. 1 and 4.

Further, the cash cassette 10 comprises a retaining element 58 which, as described in more detail in the following, serves to prevent movement of the bolting slide 24 from the locked state into the unlocked state when the cash cassette 10 is inclined at least by a minimum angle of inclination with respect to the first position. In FIG. 5, a schematic illustration of the retaining element 58 is shown.

The retaining element 58 is formed approximately like a hook and comprises a first leg 60 and a second leg 62. A first end region of the first leg 60 is connected to a first end region of the second leg 62. The first leg 60 and the second leg 62 are in particular formed in one piece.

The retaining element 58 is connected to the housing part 12 rotatably about an axis of rotation A. The axis of rotation A is directed into the plane of drawing in FIGS. 4 and 5. The axis of rotation A extends through a second end region of the first leg 60 opposite to the first end region of the first leg 60. The retaining element 58 is in particular connected to the housing part 12 rotatably about the axis of rotation A by means of a pin or a bolt.

Above a second end region of the leg 62 opposite to the first end region of the second leg 62, a retaining area 64 is formed. The retaining element 58 has a projection 66 in the retaining area 64.

The second leg 62 of the retaining element 58 has a recess 68 by which the position of the center of gravity S of the retaining element 58 as illustrated in FIG. 5 is obtained. The center of gravity S is arranged in the area of the first leg 60 near the surface 70 of the first leg 60 facing the second leg 62. By means of the gravity of the retaining element 58 applied at the center of gravity S and the rotatable mounting of the retaining element 58 about the axis of rotation A, the retaining element 58, as long as it is not impeded by other component parts, always orients such that the perpendicular from the center of gravity S to the axis of rotation A extends vertically. Such a perpendicular is illustrated by the dash and dot line 72 in FIG. 5.

As illustrated in FIGS. 1 and 4, in the first position of the cash cassette 10 the retaining element 58 is stopped by a stop 74 from orienting itself due to its gravity such that the perpendicular from the center of gravity S to the axis of rotation A extends vertically. By the stop 74, the retaining element 58 is arranged in the first position of the cash cassette 10 such that the first closing element 34 can indeed be moved in unlocking direction P1 from the locked state into the unlocked state, the retaining element 58 however only has to be rotated by a small angle relative to the housing part 12 about the axis of rotation A so that the retaining area 64 prevents a movement of the first closing element 34 from the locked state into the unlocked state in that it mechanically prevents a corresponding movement of the first closing element 34.

Figure 6:
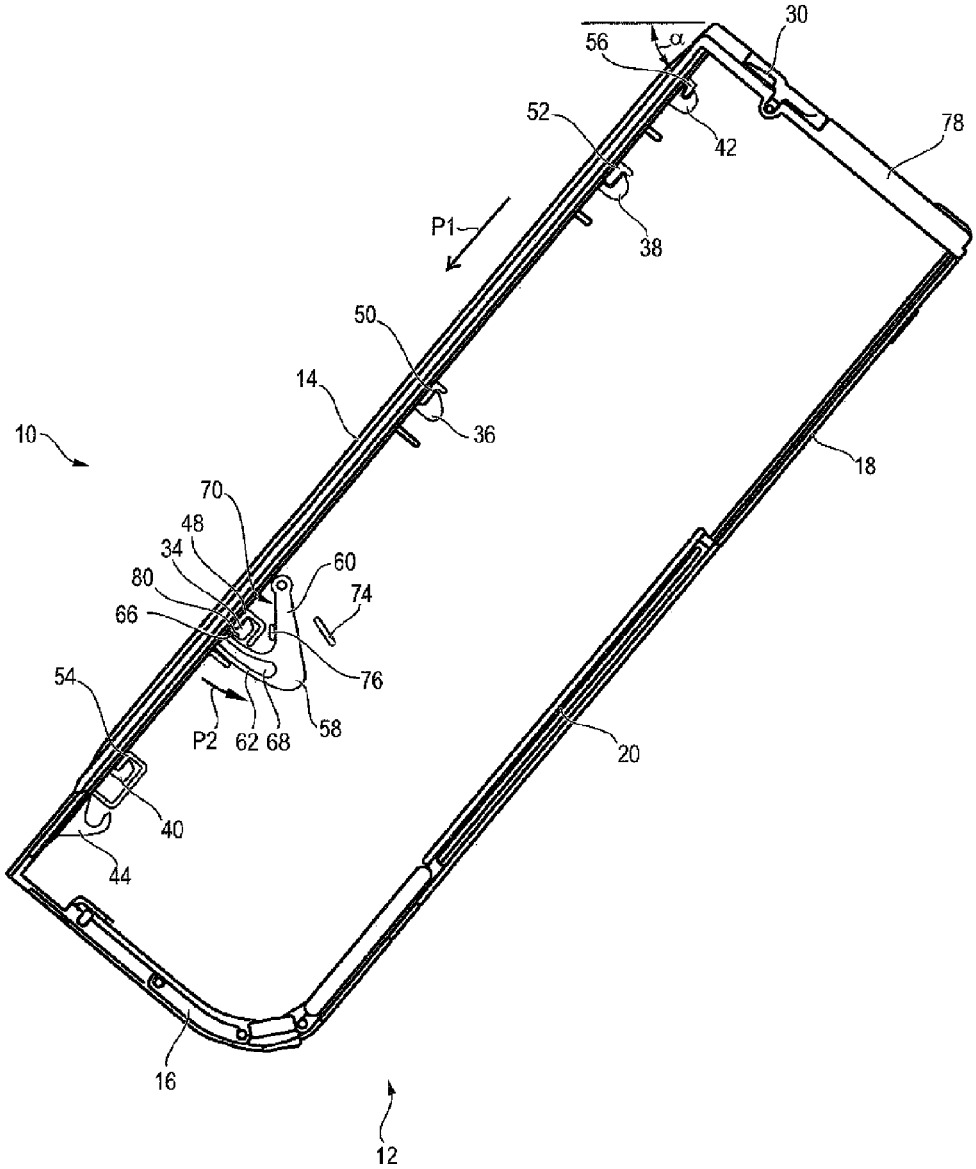
FIG. 6 shows a schematic illustration of the cash cassette according to FIGS. 1 and 4 in a second position.

In FIG. 6, a schematic illustration of the cash cassette 10 in a second position is shown. In the second position, the cash cassette 10 is inclined by an angle a with respect to the first position. Here, the cash cassette 10 is inclined such that the end of the cash cassette 10 lying in unlocking direction P1 is inclined downward. By the inclination of the cash cassette 10, the retaining element 58 loses its contact to the stop 74 and due to its gravity orients itself such that the perpendicular from its center of gravity S to the axis of rotation A extends vertically. In the second position of the cash cassette 10 illustrated in FIG. 6, the retaining element 58 is rotated relative to the housing part 12 and the cover 14 such that the retaining area 64 of the retaining element 58, as viewed in unlocking direction P1, is arranged upstream of the first closing element 34. The bolting slide 24 and thus also the closing elements 34 to 44 are arranged in the locked state in the state illustrated in FIG. 6. By the retaining element 58, a movement of the first closing element 34 and thus also of the bolting slide 24 and of the other closing elements 36 to 44 from the locked state into the unlocked state is prevented.

Figure 7:
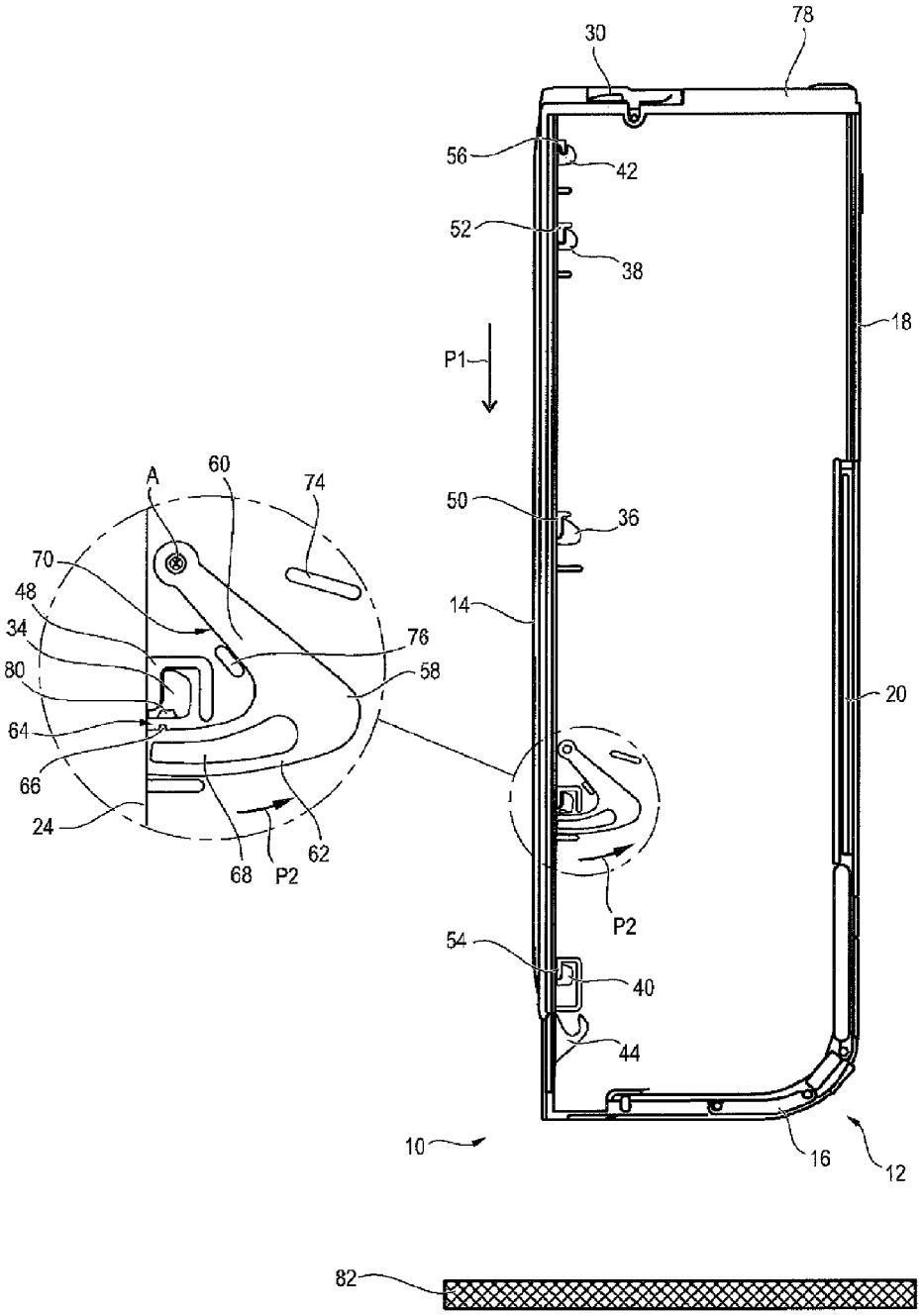
FIG. 7 shows a schematic illustration of the cash cassette according to FIGS. 1, 4 and 6 in a third position.

In the second position illustrated in FIG. 6, in which the retaining elements 58 prevents movement of the first closing element 34 from the locked state into the unlocked state, the retaining element 58 rests against a stop 76. By the position of the center of gravity S near the surface 70 of the first leg 60 facing the second leg 62 described in connection with FIG. 5 it is achieved that the retaining element 58, already when the cash cassette 10 is inclined by a small angle, is arranged such that a movement of the first closing element 34 from the locked state into the unlocked state is prevented. The angle by which the cash cassette 10 has to be inclined at least with respect to the first position so that the retaining element 58 is arranged such that it prevents displacement of the bolting slide 24 from the locked state into the unlocked state is also referred to as minimum angle of inclination. By means of the afore-described position of the center of gravity it is achieved that this minimum angle of inclination amounts to approximately 15°. In FIG. 7, a schematic illustration of the cash cassette 10 in a third position is shown. The cash cassette 10 is vertically arranged in the third position, i.e. rotated by 90° with respect to the first position. The third position is the position in which the cash cassette is usually carried during transport, as the handle for carrying the cash cassette 10 not illustrated in FIG. 7 is arranged at the side element 78 of the housing part 12 that is arranged at the top in FIG. 7. As, in the third position, the cash cassette 10 is inclined by an angle greater than the minimum angle of inclination the retaining element 58 is arranged such that a movement of the first closing element 34 from the locked state into the unlocked state is prevented.

Further, in FIG. 7 an enlarged illustration of the retaining element 58 and of the first closing element 34 is shown, in which the position of the first closing element 34 and of the retaining element 58 are illustrated in detail when the cash cassette 10 is in the third position. The retaining element 58 rests against the stop 76. Further, the retaining element 58 contacts with its second leg 62 the bolting slide 24. The first closing element 34 is arranged in the locked state due to the spring force of the tension spring 26. The retaining area 64 of the retaining element 58 and the first closing element 34 are spaced to each other. The distance between the retaining area 64 and the first closing element 34 is greater than the height of the projection 66 but only so little that the first closing element 34 is movable in unlocking direction P1 only so far that it is still engaged with the engagement area 48 of the housing part 12 and thus cannot be moved from the locked state into the unlocked state.

By the spacing between the retaining area 64 and the first closing element 34 it is achieved that the retaining element 58 can move from the position illustrated in FIG. 1 into the position illustrated in FIG. 7. Further, it is achieved in this way that the retaining element 58, when the cash cassette 10 is again moved from the third position into the first position or another position in which the cash cassette 10 is inclined with respect to the first position by an angle that is smaller than the minimum angle of inclination, again automatically rotates relative to the housing part 12 such that the first closing element 34 and thus the bolting slide 24 are again movable from the locked state into the unlocked state. In this way, it is achieved that the cover 14 of the cash cassette 10 can be opened again when the cash cassette 10 is again arranged in the first position.

Figure 8:
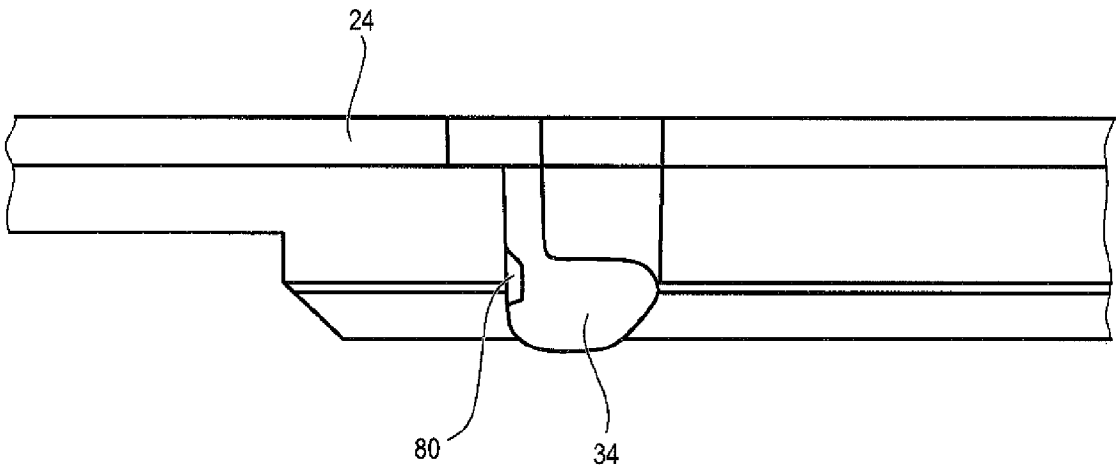
FIG. 8 shows a schematic illustration of a detail of the bolting slide according to FIG. 3.

The first closing element 34 has, as illustrated in FIG. 8, a recess 80 which is complementary to the projection 66 of the retaining element 58. In the third position of the cash cassette 10 illustrated in FIG. 7, the first closing element 34 and the retaining element 58 are arranged relative to each other such that the projection 66 and the recess 80 are arranged opposite to each other but are not engaged with each other.

Figure 9:
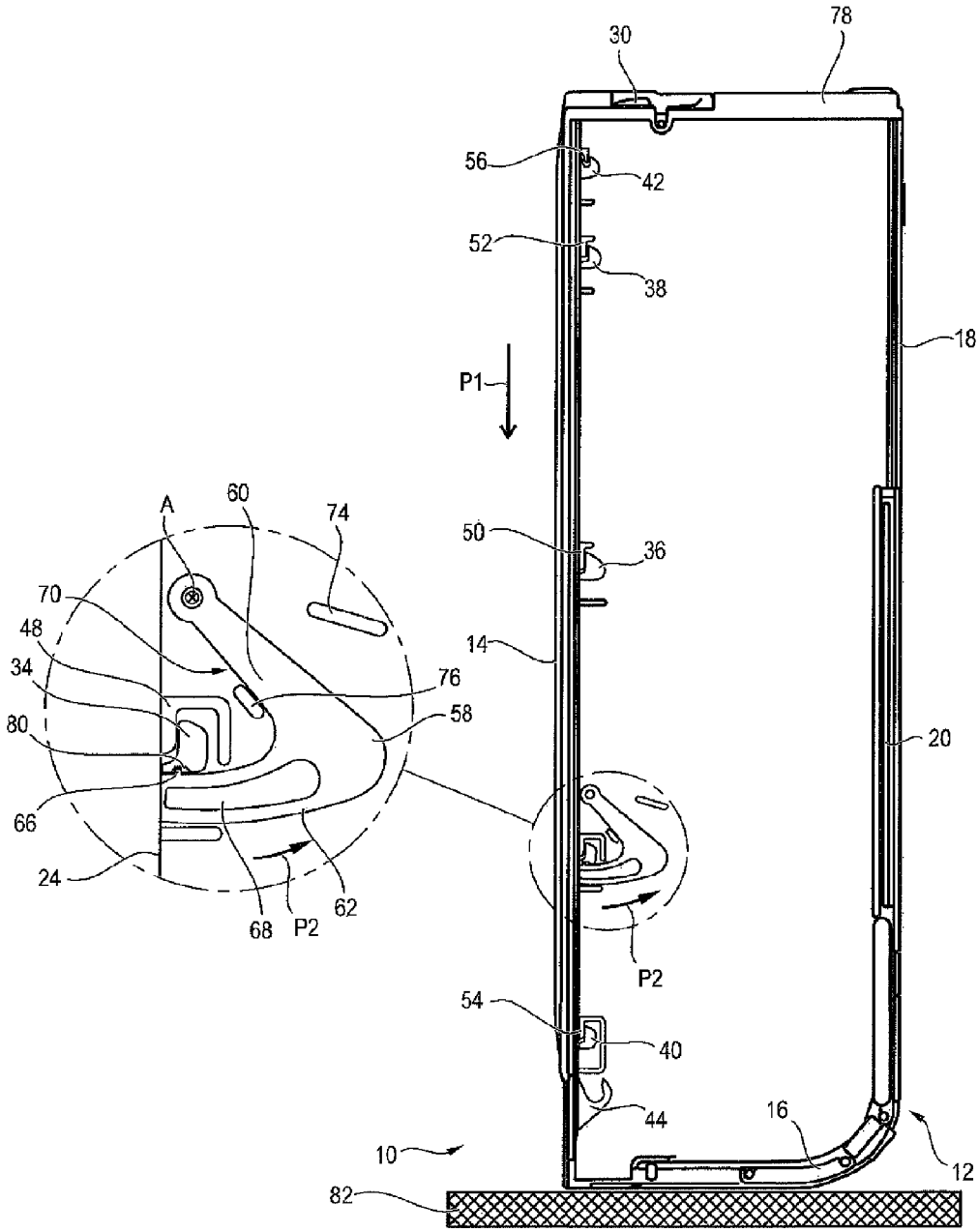
FIG. 9 shows a schematic illustration of the cash cassette according to FIGS. 1, 4, 6 and 7 in the third position upon impact on the floor.

In FIG. 9, a schematic illustration of the cash cassette 10 in the third position given a shock load on the cash cassette 10 is illustrated. During transport of the cash cassette 10 it may happen that the cash cassette 10 slips out of the hand of the person carrying the cash cassette 10 and the cash cassette 10 hits a floor 82 with the side opposite to the side element 78. When the cash cassette 10 hits the floor 82, the cash cassette 10 experiences a shock load opposite to the unlocking direction P1. When the cash cassette 10 crashes on the floor 82, the bolting slide 24 and thus also the closing elements 34 to 44 of the bolting slide 24 move further in unlocking direction P1 due to their inertia and their impulse.

In cash cassettes in which no retaining element 58 is provided it may happen that the bolting slide 24 is moved in unlocking direction P1 by the shock load so far that the closing elements 34 to 44 are no longer engaged with the engagement areas 48 to 56 and thus the bolting slide 24, by the impact on the floor 82, is moved from the locked state into the unlocked state despite the spring force of the tension spring 26 directed opposite to the unlocking direction P1 so that the cover 14 may spring open when the cash cassette 10 hits the floor 82.

By means of the inventive retaining element 58, a displacement of the bolting slide 24 from the locked state into the unlocked state due to its inertia and its impulse when the cash cassette 10 hits the floor 82 is prevented since the retaining area 64, when displacing the first closing element 34 by the corresponding contact between the retaining area 64 and the first closing element 34, mechanically prevents a further displacement of the first closing element 34 resulting from the shock load. Thus, it is prevented that the cover 14 unintentionally springs open when the cash cassette 10 hits the floor 82 so that the banknotes contained in the cash cassette 10 cannot fall out of the cash cassette 10.

As already stated, the bolting slide 24 and thus also the first closing element 34 are moved so far in unlocking direction P1 when the cash cassette 10 hits the floor 82 until the first closing element 34 contacts the retaining element 58. Here, the projection 66 of the retaining element 58 engages with the recess 80 of the first closing element 34 and thus prevents that the retaining element 58, when the cash cassette 10 hits the floor 82, is pivoted such that it no longer prevents movement of the first closing element 34 from the locked state into the unlocked state. In particular, by the engagement between the projection 66 and the recess 80 a pivoting of the retaining element 58 in the direction of the arrow P2 is prevented.

After the cash cassette 10 has hit the floor 82 and thus when no shock load 10 is experienced any more, the bolting slide 24 and thus also the first closing element 34 are again moved into the locked state illustrated in FIG. 7 by the spring force of the tension spring 26 so that the projection 66 of the retaining element 58 is no longer engaged with the recess 80 of the first closing element 34. Thus, the retaining element 58, when the cash cassette 10 is again rotated such that it is inclined by an angle that is smaller than the minimum angle of inclination, can rotate relative to the housing part 12 such that the bolting slide 24 is again movable from the locked state into the unlocked state. The cash cassette 10 can then be opened again without the retaining element 58 having to be moved manually and/or by an actuator.

The rear end of the closing elements 34 to 42 as viewed in unlocking direction P1 is beveled each time. By means of the beveled ends it is achieved that the closing elements 34 to 42, when closing the cover 14, move in unlocking direction P1 opposite to the spring force of the tension spring 26 due to the contact with the housing part 12 until they engage with the engagement areas 48 to 56.

The closing elements 34 to 42 are in particular formed identically. In alternative embodiments of the invention the closing elements 34 to 42 can also vary. Likewise, the closing elements 34 to 42 can also have a shape different from the L-shape.

In an alternative embodiment of the invention, the bolting slide 24 can also comprise less than six closing elements 34 to 44 or more than six closing elements 34 to 44. In another alternative embodiment of the invention, the cash cassette 10 can also comprise two or more retaining elements 58. The retaining elements 58 are then arranged such that by a retaining element 58 each time a movement of a closing element 34 to 42 from the locked state into the unlocked state is prevented when the cash cassette 10 is inclined by at least the minimum angle of inclination.

In a further alternative embodiment of the invention, the retaining element 58 can also have no projection 66. In this case, the closing element 34 preferably has no recess 80. In this embodiment, the retaining element 58 is in particular arranged such that, when the container 10 is inclined by at least the minimum angle of inclination, it contacts the first closing element 34 and thus prevents a movement of the first closing element 34 in unlocking direction P1 or, respectively, at most allows a minimum movement of the first closing element 34 in unlocking direction P1.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

The invention claimed is:

1. A container for holding notes of value, comprising a housing part which has at least one opening and in which the notes of value can be held, and a cover for closing the opening of the housing part, wherein the cover comprises a closing element movable in at least one unlocking direction, the closing element, in a locked state, is engaged with an engagement area of the housing part that is complementary to the closing element so that the cover is firmly connected to the housing part, the closing element is movable in the unlocking direction into an unlocked state for unlocking so that the cover can be opened, a retaining element rotatably mounted about an axis of rotation is provided which, in a first position of the container, is arranged such that the closing element is movable in the unlocking direction from the locked state into the unlocked state for unlocking and which, in a second position of the container, is rotated relative to the housing part due to gravity such that a retaining area of the retaining element prevents a movement of the closing element from the locked state into the unlocked state, and wherein the container, in the second position, is inclined by at least a minimum angle of inclination with respect to the first position in which the container is arranged horizontally.

2. The container according to claim 1, wherein a housing bottom formed by an area of the housing part of the container is arranged horizontally in the first position, and in that the retaining element prevents a movement of the closing element from the locked state into the unlocked state as soon as the minimum angle of inclination of the container is at least 15° with respect to the first position.

3. The container according to claim 1, wherein the retaining element, as a result of a movement of the container from a position with an angle of inclination greater or equal to the minimum angle of inclination into a position with an angle of inclination smaller than the minimum angle of inclination, moves relative to the housing part from a position in which it prevents a movement of the closing element from the locked state into the unlocked state automatically into a position in which the closing element is movable from the locked state into the unlocked state.

4. The container according to claim 1, wherein the retaining element is approximately shaped like a hook.

5. The container according to claim 1, wherein the retaining element comprises a first leg and a second leg, in that a first end region of the first leg is connected to a first end region of the second leg, in that the axis of rotation extends through a second end region of the first leg, and in that the distance from the center of gravity of the retaining element to the surface of the first leg facing the second leg is smaller than the distance from the center of gravity to the surface of the first leg facing away from the second leg.

6. The container according to claim 5, wherein the second leg has a recess for reducing the weight.

7. The container according to claim 1, wherein the retaining area has a projection, in that the closing element has a recess that is complementary to the projection, and in that the projection is engaged with the recess when the container is inclined by at least the minimum angle of inclination and a shock directed opposite to the unlocking direction acts on the container.

8. The container according to claim 1, wherein the closing element is held by means of an elastic element, such that it is engaged with the engagement area.

9. The container according to claim 1, wherein the closing element is a first closing element, in that the cover comprises a bolting slide having the first closing element, a second, a third, and a fourth closing element, in that each of the first, the second, the third and the fourth closing element is L-shaped, and in that each of the closing elements is engaged with the engagement area of the housing part in the locked state.

10. The container according to claim 9, wherein the bolting slide has an actuating element, by the manual actuation of which the bolting slide is moved in the unlocking direction such that the closing elements are no longer engaged with the housing part.

11. The container according to claim 1, wherein the notes of value are banknotes.

12. The container according to claim 1, wherein the container is a cash cassette, in that the first position of the cash cassette is the position which the cash cassette has when it is arranged in an automated teller machine, and in that the cash cassette comprises a handle for carrying the cash cassette, wherein the cash cassette, when carried by the handle, is inclined by at least the minimum angle of inclination.

13. The container according to claim 1, wherein the container, when inclined by the minimum angle of inclination, is inclined such that the end of the container lying in the unlocking direction is inclined downward.

14. A method of closing a container for holding notes of value, which container comprises a housing part and a cover, in which a closing element of the cover is engaged with an engagement area of the housing part that is complementary to the closing element for locking the container so that the cover is firmly connected to the housing part, the closing element is moved in an unlocking direction from the locked state into the unlocked state for unlocking so that the cover can be opened, in which a retaining element which is rotatably mounted about an axis of rotation and which, in a horizontal first position of the container, is arranged such that the closing element is movable in the unlocking direction from the locked state into an unlocked state for unlocking is rotated by gravity relative to the housing part so that by a retaining area of the retaining element a movement of the closing element in the unlocking direction from the locked state into the unlocked state is prevented when the container is inclined to a second position by at least a minimum angle of inclination with respect to the horizontal first position.

15. A container for holding notes of value comprising:

a housing defining both a receptacle for storing the notes of value and an opening of the receptacle;

a cover configured to close the opening;

a closing element of the cover movable in at least one unlocking direction from a locked position to an unlocked position, in the locked position the closing element is engaged with an engagement area of the housing that is complementary to the closing element such that the cover is firmly connected to the housing part, in the unlocked position the closing element is disengaged from the engagement area thereby permitting the cover to be opened; and a retaining element rotatably mounted about an axis of rotation, the retaining element defining a retaining area;

wherein:

in a first position of the container in which the container is horizontally arranged, the retaining element is arranged such that the retaining area thereof permits movement of the closing element in the unlocking direction from the locked position to the unlocked position;

in a second position of the container in which the container is inclined by at least a minimum angle of inclination with respect to the first position, the retaining element is rotated relative to the housing due to gravity such that the retaining area prevents movement of the closing element from the locked position to the unlocked position; and upon moving the container from being inclined by at least the minimum angle of inclination in the second position to being inclined at an angle smaller than the minimum angle of inclination, the retaining element rotates relative to the housing part such that the retaining element no longer prevents movement of the closing element from the locked position to the unlocked position.

16. The container of claim 15, wherein the retaining element is approximately shaped as a hook.

17. The container of claim 15, wherein the retaining element includes a first leg and a second leg, a first end region of the first leg is connected to a first end region of the second leg, the axis of rotation extends through a second end region of the first leg, and a distance from the center of gravity of the retaining element to a surface of the first leg facing the second leg is smaller than a distance from the center of gravity to a surface of the first leg facing away from the second leg.

18. The container of claim 17, wherein the second leg has a recess for reducing weight of the retaining element.

19. The container of claim 15, wherein the retaining element includes a tab projecting into the retaining area, and the closing element defines a recess configured to couple with the tab when the container is inclined by at least the minimum angle of inclination.

20. The container of claim 15, wherein the closing element is a first closing element, the engagement area is one of a plurality of different engagement areas, and the cover includes a bolting slide having the first closing element, a second closing element, a third closing element, and a fourth closing element, each one of the first, second, third, and fourth closing element are L-shaped and are configured to engage with one of the plurality of engagement areas.

* * * * *